US005883654A

United States Patent [19]

Katsuyama

[11] Patent Number: 5,883,654

[45] Date of Patent: Mar. 16, 1999

[54] PRINTER HAVING SHEET CONVEY APPARATUS FOR CONVEYING ADHERED SHEET

[75] Inventor: Hitoshi Katsuyama, Tokyo, Japan

[73] Assignee: Canon Kabushiki Kaisha, Japan

[21] Appl. No.: 576,335

[22] Filed: Dec. 21, 1995

[30] Foreign Application Priority Data

Dec. 26, 1994 [JP] Japan ..... 6-322296

[51] Int. Cl.[6] ..... B41J 2/01

[52] U.S. Cl. ..... 347/104

[58] Field of Search ..... 347/139, 154, 347/149, 104; 346/136; 451/296; 101/126, 219

[56] References Cited

U.S. PATENT DOCUMENTS

| | | | |
|---|---|---|---|
| 4,756,788 | 7/1988 | Bedell et al. | 156/382 |
| 4,810,006 | 3/1989 | Katz | 281/5 |
| 4,863,086 | 9/1989 | Armelin | 226/152 |
| 5,225,853 | 7/1993 | Kobayashi et al. | 347/33 |
| 5,345,863 | 9/1994 | Kurata et al. | 101/126 |
| 5,485,190 | 1/1996 | Koetter et al. | 347/130 |

FOREIGN PATENT DOCUMENTS

| | | |
|---|---|---|
| 0 305 230 | 3/1989 | European Pat. Off. . |
| 1008816 | 5/1952 | France . |
| 63-50567 | 3/1988 | Japan . |
| 5-51637 | 7/1993 | Japan . |

*Primary Examiner*—Shawn Riley
*Attorney, Agent, or Firm*—Fitzpatrick, Cella, Harper & Scinto

[57] ABSTRACT

A sheet convey apparatus and a printer having such a sheet convey apparatus have rock arms rockable around a rotational center of a driven roller on which an endless belt is supported. Urging roller attaching plates for supporting the urging roller, a transmission shaft, urging roller driving arms and urging cylinders are attached to the rock arms, and the urging cylinders can abut against the corresponding urging roller driving arms. Urging force releasing springs are connected between the urging roller driving arms and the rock arms. When the urging cylinders are extended, the urging roller is urged against the endless belt, and, when the urging cylinders are retracted, the urging force of the urging roller is released. In this way, a sheet urging force is kept constant to eliminate unevenness of the contact between the sheet and the endless belt, and any streak is prevented from being formed on the sheet.

31 Claims, 13 Drawing Sheets

PRINTER HAVING SHEET CONVEY APPARATUS FOR CONVEYING ADHERED SHEET

BACKGROUND OF THE INVENTION

1. Field of the Invention

The present invention relates to a printer for printing a picture, a figure or the like on a sheet such as cloth.

2. Related Background Art

As an example of prior arts, in a technique disclosed in Japanese Utility Model Laid-open No. 5-51637 (1993) (referred to as "prior art example" hereinafter), as shown in FIGS. 12 and 13, a cloth web 101 wound on a take-out roll 100*a* and a take-up roll 100*b* is directed to an endless belt 102 mounted around rollers 102*a*–102*c*, and, ink is discharged from an ink jet head 103 in response to image information, thereby printing an image.

An urging roller 104 for closely contacting the cloth web 101 with the endless belt 102 is supported by a support member 105 such as a lever and a drive mechanism 106 such as an air cylinder is connected to the support member 105. By actuating the drive mechanism 106, the support member 105 and the urging roller 104 can be shifted so that the urging roller 104 is retarded from the endless belt 102 to be spaced apart from the cloth web 102 or the urging roller 104 is urged against the endless belt 102 to closely contact the cloth web 101 with the endless belt 102. Further, a control device 107 is connected to the drive mechanism 106. After the endless belt 102 is stopped, the drive mechanism 106 is controlled by the control device 107 so that the urging roller 104 is retarded from the cloth web 101, and, after the endless belt 102 is operated again, the drive mechanism 106 is controlled by the control device 107 so that the urging roller 104 is urged against the cloth web 101.

However, in the apparatus according to the abovementioned prior art example, since the urging roller 104 is merely urged against or separated from the endless belt 102, the following problem arises.

That is to say, after the urging roller 104 is urged against the cloth web 101 on the endless belt 102 by means of the drive mechanism 106, the endless belt 102 is operated. With this arrangement, since the urging roller 104 urges the same area of the cloth web 101 for a predetermined time period until the endless belt 102 is operated again, a streak is generated on that area of the cloth web. Further, there also arises a problem that unevenness of the close contact is apt to occur since the cloth web 102 is closely contacted with the endless belt 102 which is intermittently operated at a high speed.

SUMMARY OF THE INVENTION

The present invention aims to solve the abovementioned conventional problems, and an object of the present invention is to provide a printer in which unevenness of close contact can be eliminated by maintaining a sheet tension force constant and the occurrence of a streak can be prevented.

To achieve the above object, according to the present invention, there is provided a sheet convey apparatus comprising an endless belt mounted around a plurality of rotary members and adapted to support and convey a sheet, an urging rotary member for directing the sheet to the endless belt and for urging the sheet against the endless belt to closely contact the sheet with the endless belt, a support means pivotally supported by one of the plurality of rotary members and adapted to support the urging rotary member, an urging force applying means for applying a force capable of urging the sheet against the endless belt to the urging rotary member supported by the support means, and a drive means for driving the support means.

The support means may include a support member for supporting the urging rotary member, and a rock member connected to the support member and pivotally supported by one of the plurality of rotary members. Further, the sheet convey apparatus may further comprise an urging force releasing means connected to the support member and adapted to release an urging force of the urging rotary member against the endless belt.

The drive means may be connected to the support means. Further, the drive means may be designed to drive a gear supported by the support means and meshed with a gear provided on a shaft of the rotary member. In addition, the drive means may be continuously operated regardless of operative and inoperative conditions of the endless belt.

Further, the support means may be pivotally supported by a driven rotary member among the plurality of rotary members.

According to another aspect of the present invention, there is provided a sheet convey apparatus comprising an endless belt mounted around a plurality of rotary members and adapted to support and convey a sheet, an urging rotary member for directing the sheet to the endless belt and for urging the sheet against the endless belt to closely contact the sheet with the endless belt, and a shifting means for shifting the urging rotary member relative to the endless belt at a constant relative speed.

According to a further aspect of the present invention, there is provided a printer comprising an endless belt mounted around a plurality of rotary members and adapted to support and convey a sheet, an urging rotary member for directing the sheet to the endless belt and for urging the sheet against the endless belt to closely contact the sheet with the endless belt, a support means pivotally supported by one of the plurality of rotary members and adapted to support the urging rotary member, an urging force applying means for applying a force capable of urging the sheet against the endless belt to the urging rotary member supported by the support means, a drive means for driving the support means, and a recording means for effecting the recording on the sheet closely contacted with the endless belt. The drive means may be continuously operated regardless of operative and inoperative conditions of the endless belt.

According to a still further aspect of the present invention, there is provided a printer comprising an endless belt mounted around a plurality of rotary members and adapted to support and convey a sheet, an urging rotary member for directing the sheet to the endless belt and for urging the sheet against the endless belt to closely contact the sheet with the endless belt, a shifting means for shifting the urging rotary member relative to the endless belt at a constant relative speed, and a recording means for effecting the recording on the sheet closely contacted with the endless belt. The recording means may include an ink jet head. Further, the ink jet head may discharge ink droplets generated by thermal energy to effect the recording.

Since the sheet convey apparatus according to the present invention is constructed as mentioned above, by continuously driving the urging force applying means for urging the urging rotary member against the endless belt regardless of operative and inoperative conditions of the endless belt, it is possible to closely contact the entire area of the sheet against the endless belt with a constant urging force. Further, since the urging force applying means can always urge the urging rotary member against the endless belt without repeating the contact and separation of the urging rotary member with respect to the endless belt and since the rock member for rocking the urging rotary member with respect to the driven rotary member for the endless belt, a streak is not generated on the sheet.

DETAILED DESCRIPTION OF THE PREFERRED EMBODIMENTS

Figure 1:
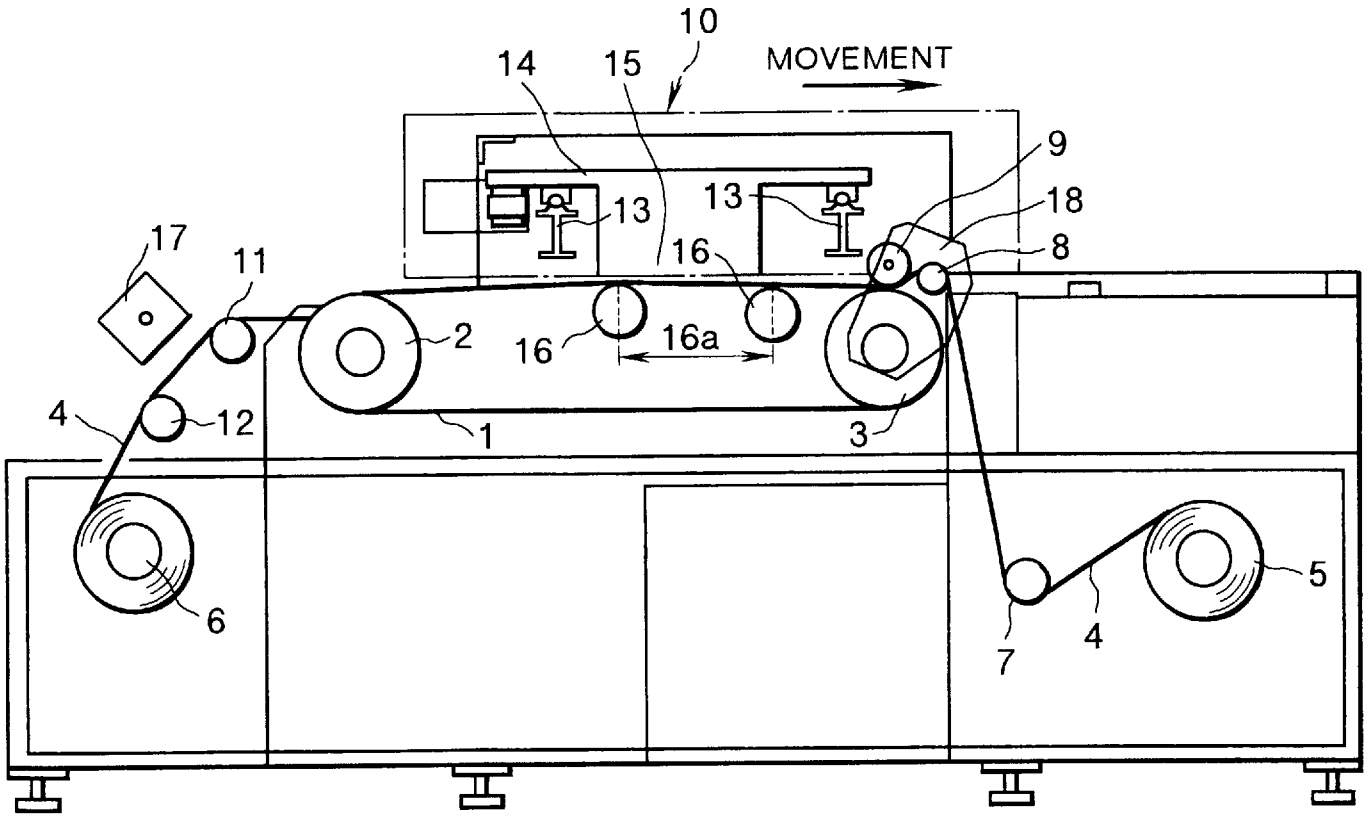
FIG. 1 is a schematic sectional view of a printer to which the present invention is applied.

A sheet convey apparatus and a printer having such a sheet convey apparatus will now be fully described with reference to the accompanying drawings. FIG. 1 is a schematic sectional view of an ink jet printer to which the present invention is applied.

In FIG. 1, an endless belt 1 is wound around and supported by a drive roller (drive rotary member) 2 and a driven roller (driven rotary member) 3. The drive roller 2 is connected to a drive motor so that, by controlling the drive motor, the drive roller 2 is rotated to intermittently shift the endless belt 1. The driven roller 3 is driven by the movement of the endless belt 1.

A sheet (cloth web) 4 is wound around a take-out roll 5 and is wound up by a take-up roll 6. That is to say, the cloth web 4 unwound from the take-out roll 5 is passed through guide rollers 7, 8, and then is directed onto the endless belt 1 by an urging roller (urging rotary member) 9. Then, the cloth web is passed through a print area (to which a printer unit 10 is opposed) and guide rollers 11, 12 and is wound up by the take-up roll 6.

A surface of the endless belt 1 is treated by an adhesive or the like so that, when the cloth web 4 is urged against the endless belt 1 by the urging roller 9, the cloth web 4 can be adhered to the surface of the endless belt 1, and, when the cloth web 4 adhered to the surface of the endless belt 1 is passed through a curvature portion of the drive roller 2 together with the endless belt 1, the cloth web 4 can easily be peeled from the endless belt 1.

The printer unit 10 comprises a carriage 14 shiftable along guide rails 13 in a direction perpendicular to a cloth web conveying direction and an ink jet head 15 mounted on the carriage 14 in a confronting relation to the endless belt 1. The printer unit 10 itself can be shifted by means of a shifting means (not shown) in the cloth web conveying direction so that the cloth web 4 closely contacted with the endless belt 2 is scanned by the ink jet head 15.

The ink jet head 15 used in the illustrated embodiment has nozzles within which heat generating elements are disposed. When the desired heat generating element is energized to provide thermal energy, a bubble is created in the corresponding nozzle, and, as the bubble is expanded, an ink droplet is discharged from the nozzle.

In the print area to which the ink jet head 15 is opposed, a portion of the endless belt 1 is maintained in parallel with the ink jet head by a platen portion 16*a* defined by two platen rollers 16, so that the cloth web 4 adhered to the endless belt 1 is also maintained in parallel with the ink jet head. After the endless belt 1 is stopped, the ink droplets are discharged from the ink jet head 15 while scanning the cloth web in a predetermined direction, thereby performing a desired printing operation. A portion of the cloth web 4 on which the image was printed is conveyed by the movement of the endless belt 1 in a downstream direction. Meanwhile, the cloth web is guided by the guide rollers 11, 12 to reach a drying heater 17, where the ink on the cloth web is dried. Thereafter, the cloth web is wound around the take-up roll 6.

Figure 2:
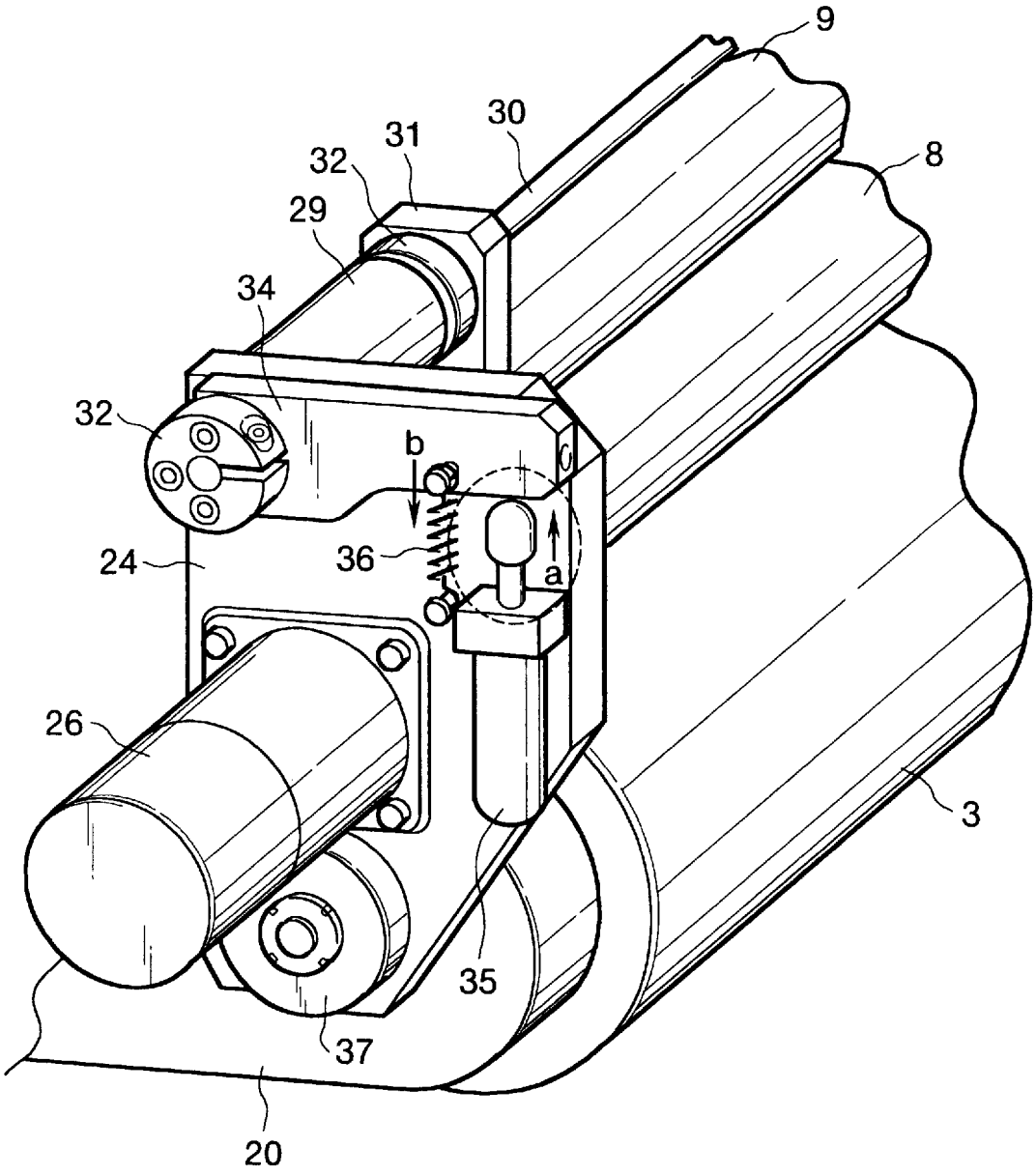
FIG. 2 is a schematic perspective view showing an urging rotary member and surrounding elements.
Figure 4:
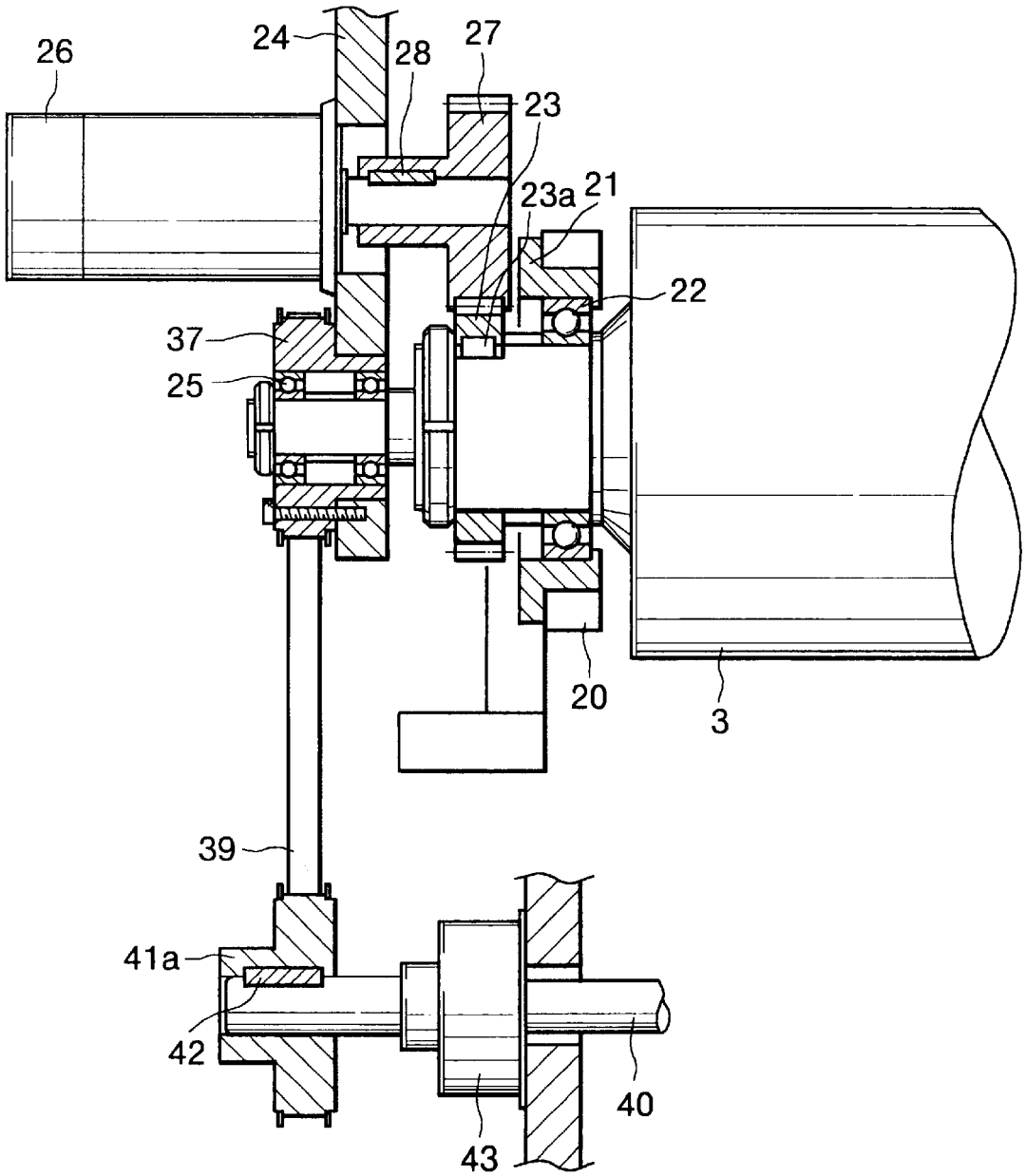
FIG. 4 is a partial sectional view of the driven rotary member portion.
Figure 5:
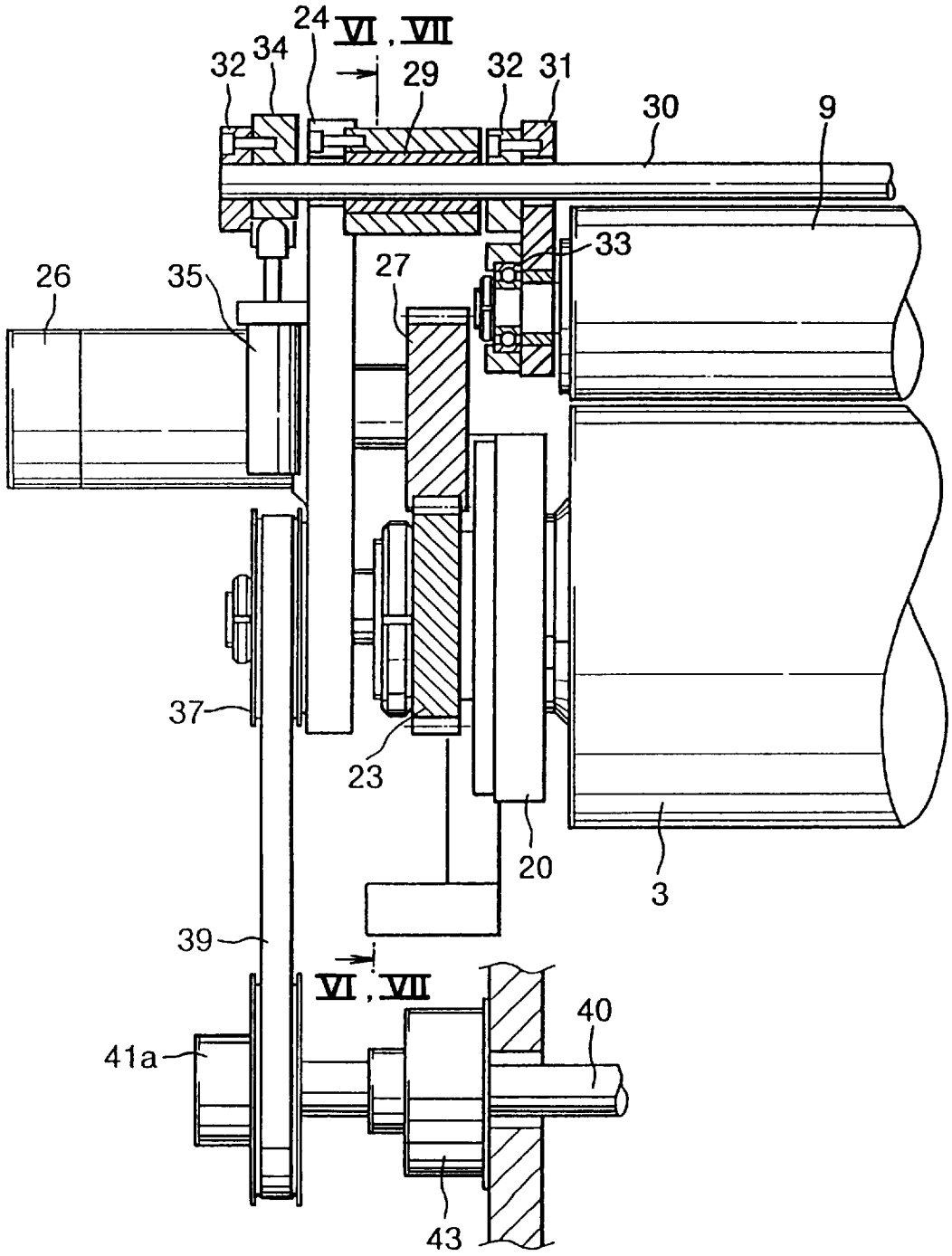
FIG. 5 is a partial sectional view of the urging rotary member portion.
Figure 6:
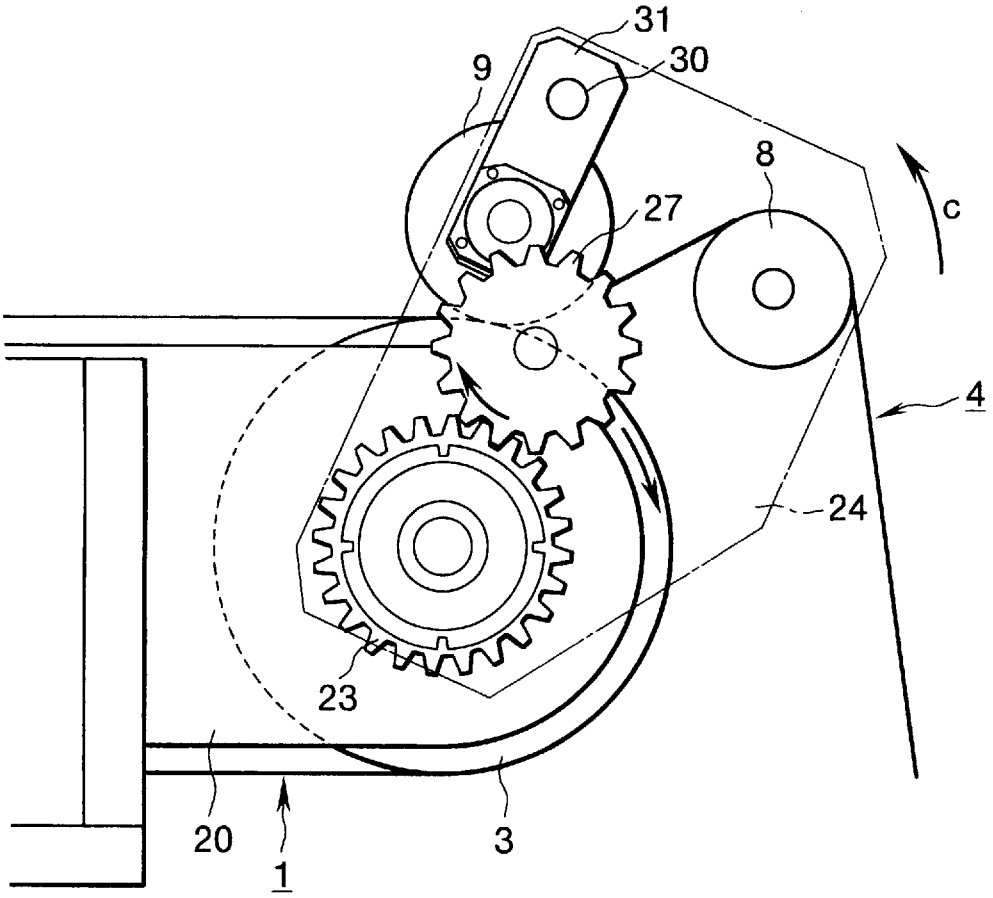
FIG. 6 is a sectional view taken along the line VI—VI in FIG. 5, showing a rocking operation of a rocking member.
Figure 7:
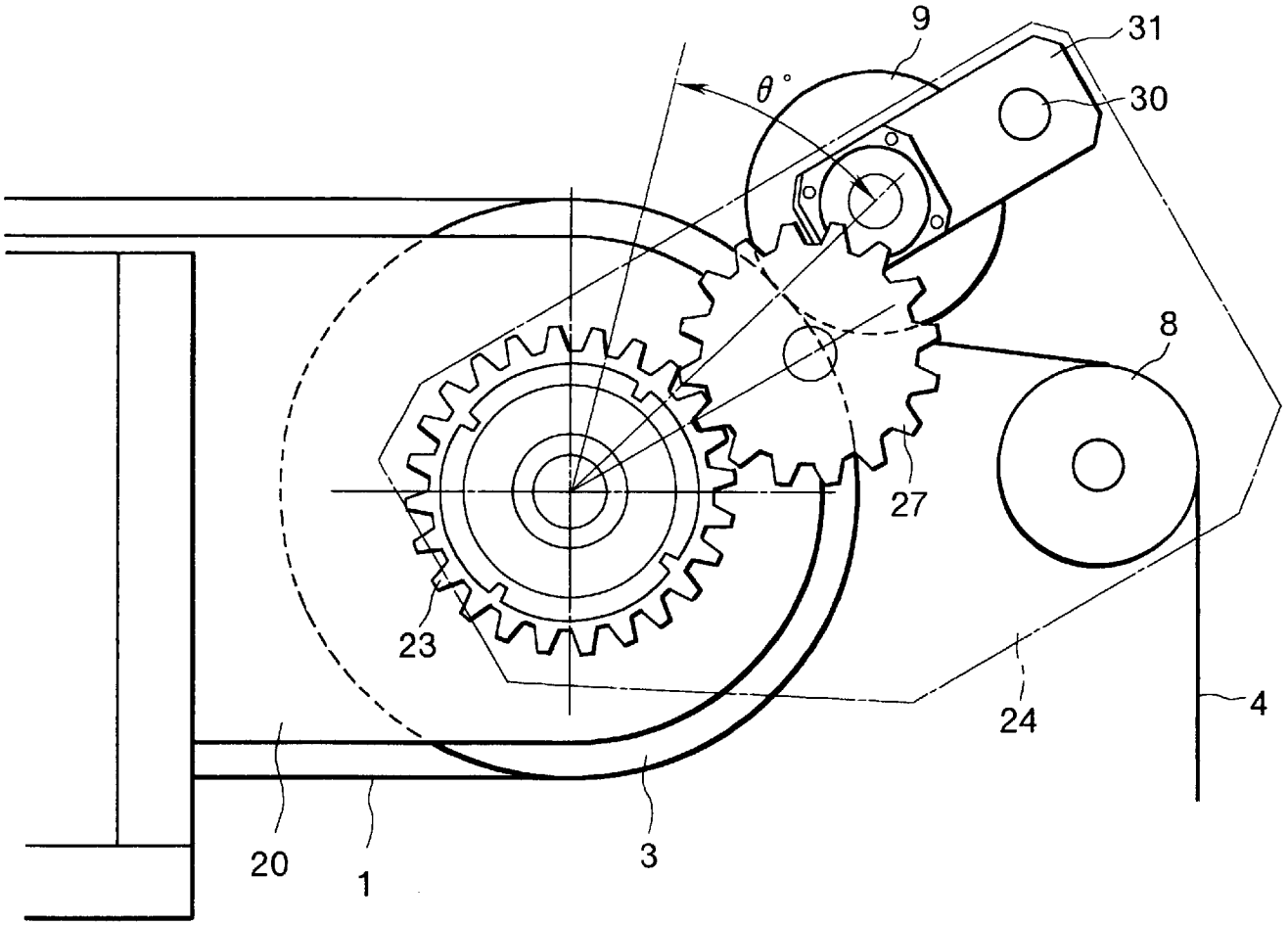
FIG. 7 is a sectional view taken along the line VI—VI in FIG. 5, showing a rocking angle of the urging rotary member.
Figure 8:
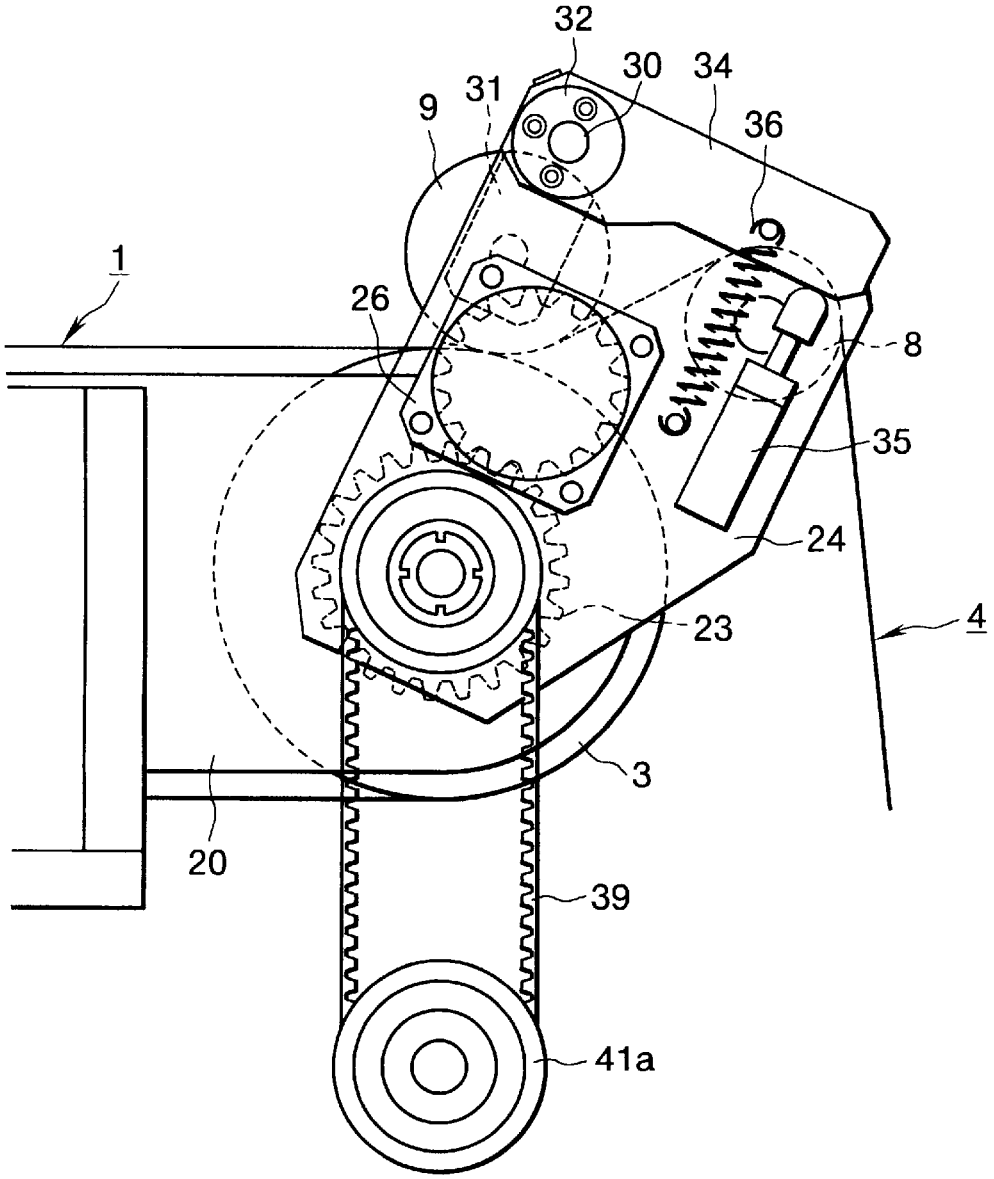
FIG. 8 is an explanatory view showing a condition that the urging rotary member is urged against the endless belt.
Figure 9:
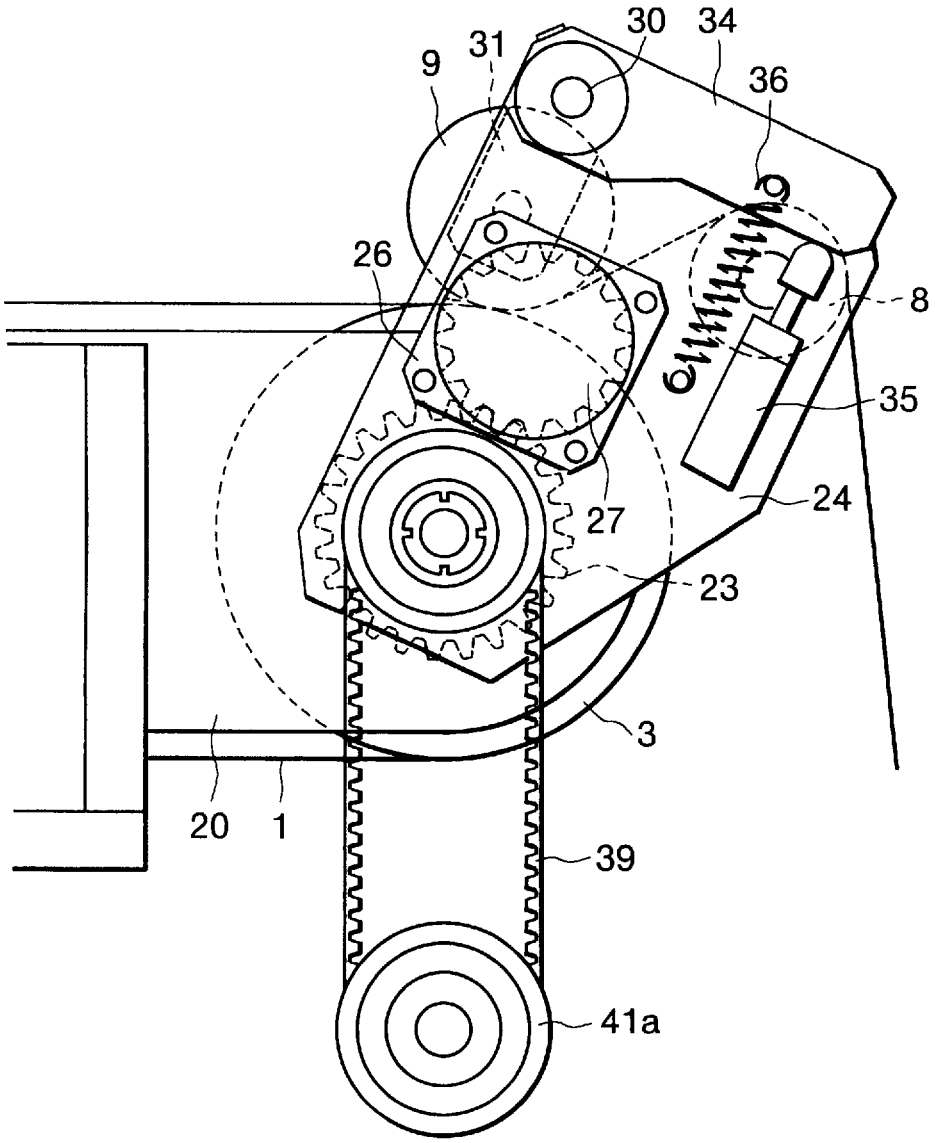
FIG. 9 is an explanatory view showing a condition that an urging force of the urging rotary member is released.
Figure 10:
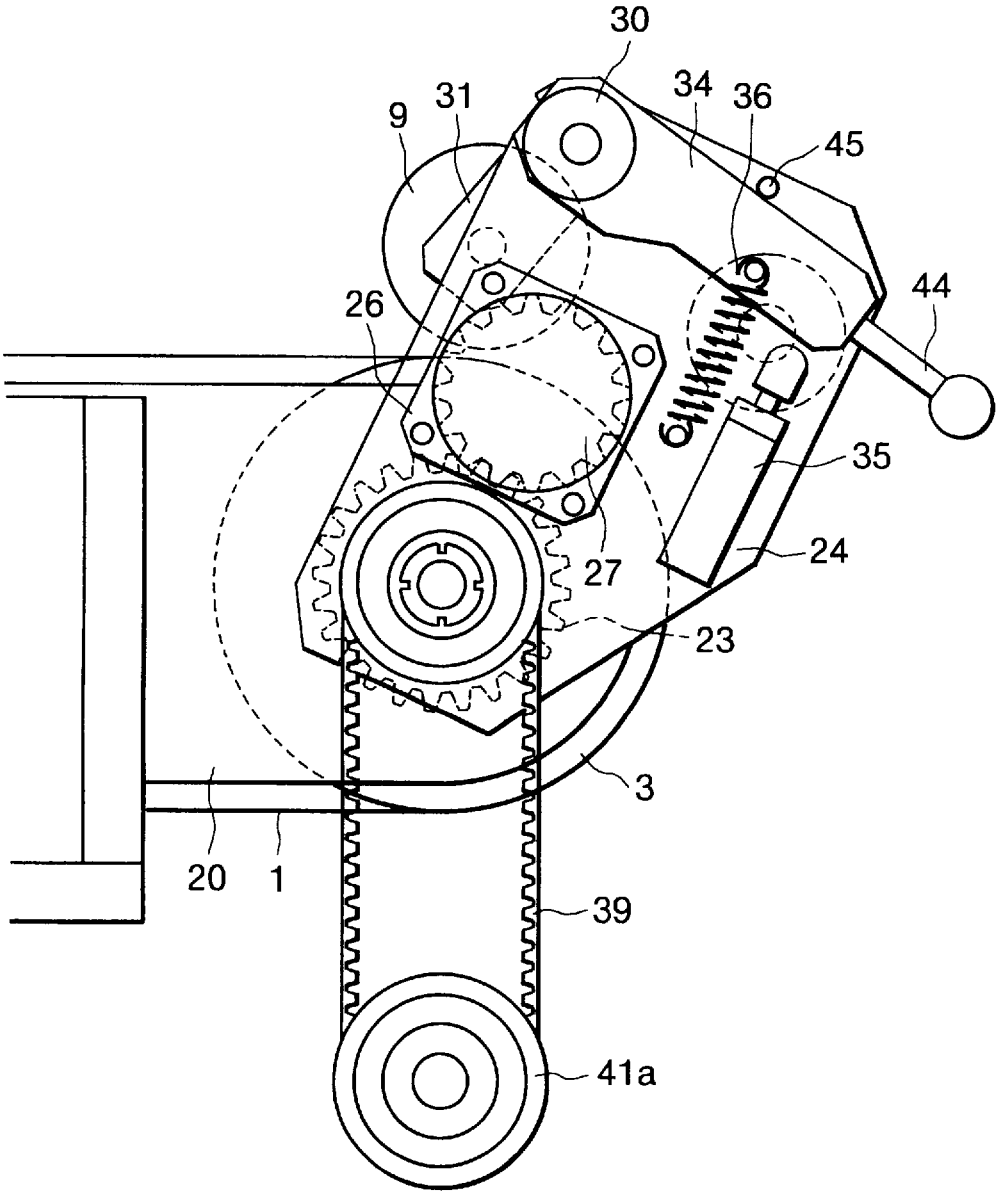
FIG. 10 is an explanatory view showing a condition that the urging rotary member is separated from the endless belt.
Figure 11:
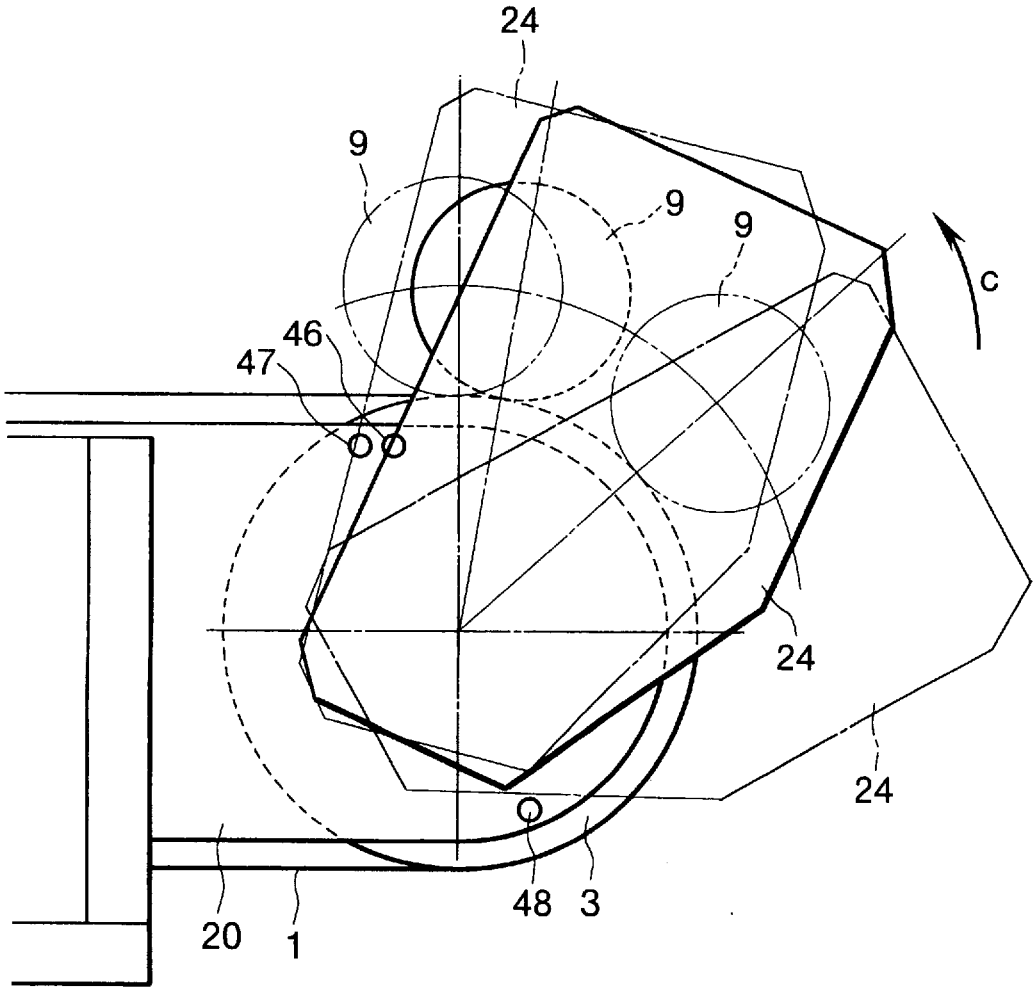
FIG. 11 is an explanatory view showing an arrangement of sensors for detecting a position of the rock member.
Figure 12:
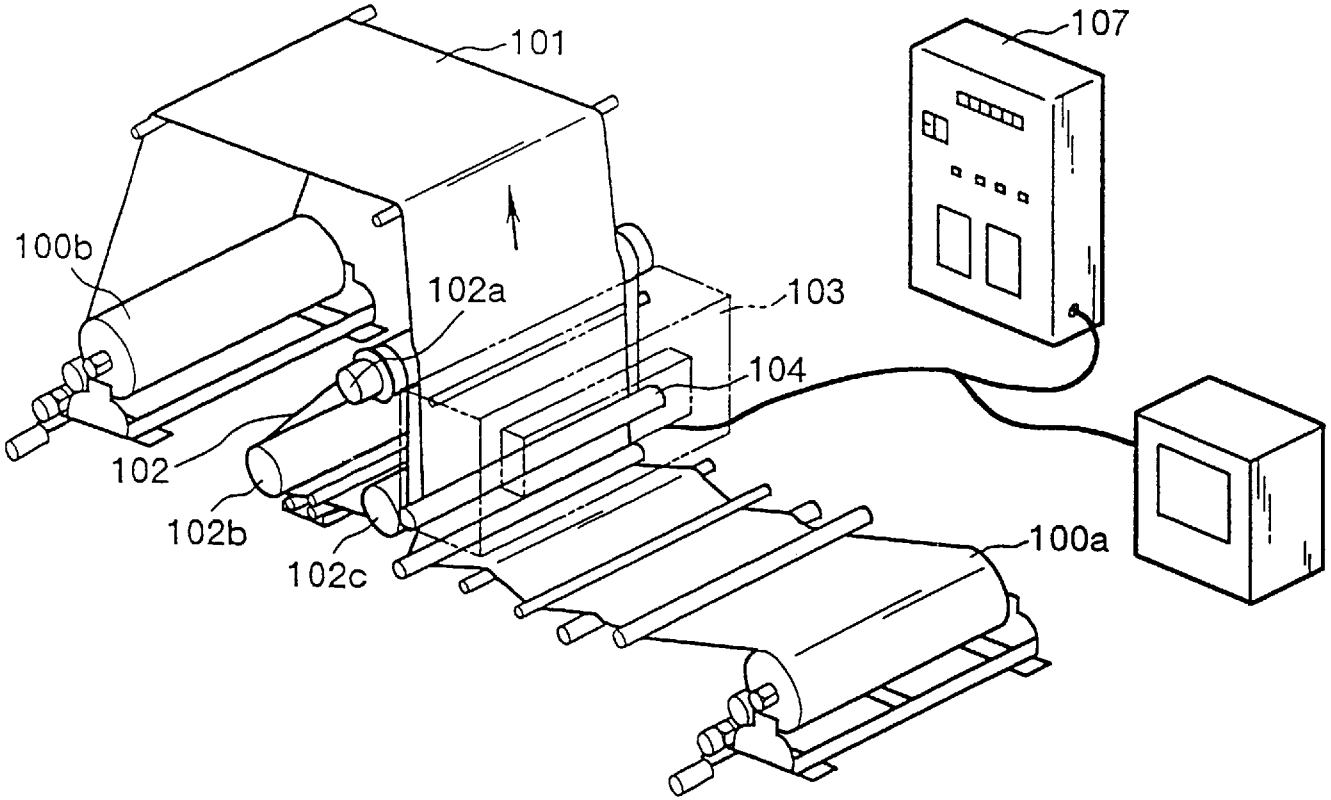
FIG. 12 PRIOR ART
FIGS. 12 and 13 are explanatory views for explaining a prior art example.
Figure 13:
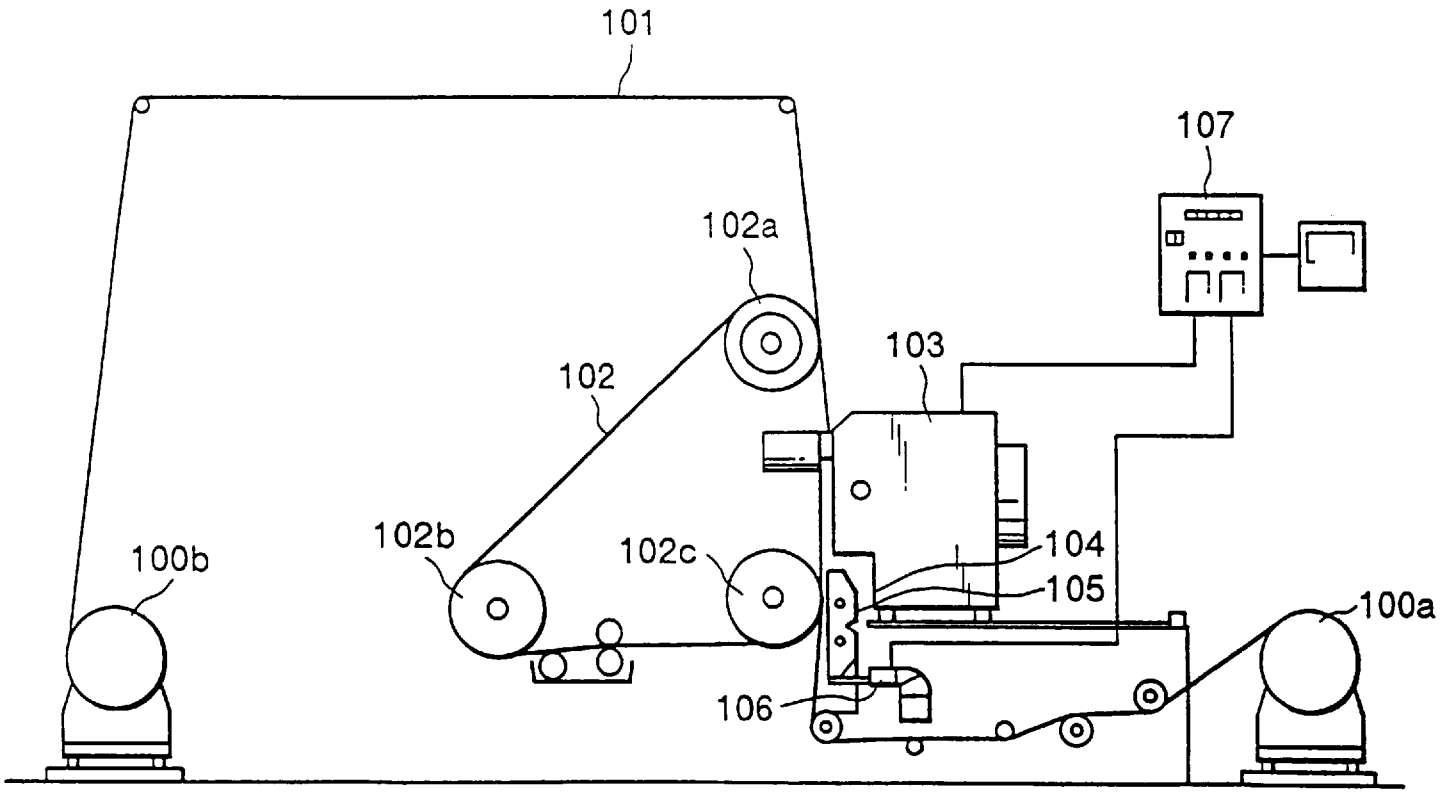
FIG. 13 PRIOR ART

Next, an urging mechanism 18 for closely contacting the cloth web 4 with the endless belt 1 will be explained with reference to FIGS. 2 to 11. FIG. 2 is a schematic perspective view showing an urging rotary member and its surrounding area, FIG. 3 is a plan view, in partial section, of the urging rotary member, a driven rotary member and its surrounding area viewed from an upstream side in the endless belt conveying direction, FIG. 4 is a partial sectional view of the driven rotary member portion, FIG. 5 is a partial sectional view of the urging rotary member portion, FIG. 6 is a sectional view taken along the line VI—VI in FIG. 5, showing a rocking operation of a rocking member, FIG. 7 is a sectional view taken along the line VI—VI in FIG. 5, showing a rocking angle of the urging rotary member, FIG. 8 is an explanatory view showing a condition that the urging rotary member is urged against the endless belt, FIG. 9 is an explanatory view showing a condition that an urging force of the urging rotary member is released, FIG. 10 is an explanatory view showing a condition that the urging rotary member is separated from the endless belt, and FIG. 11 is an explanatory view showing an arrangement of sensors for detecting a position of the rock member.

Figure 3:
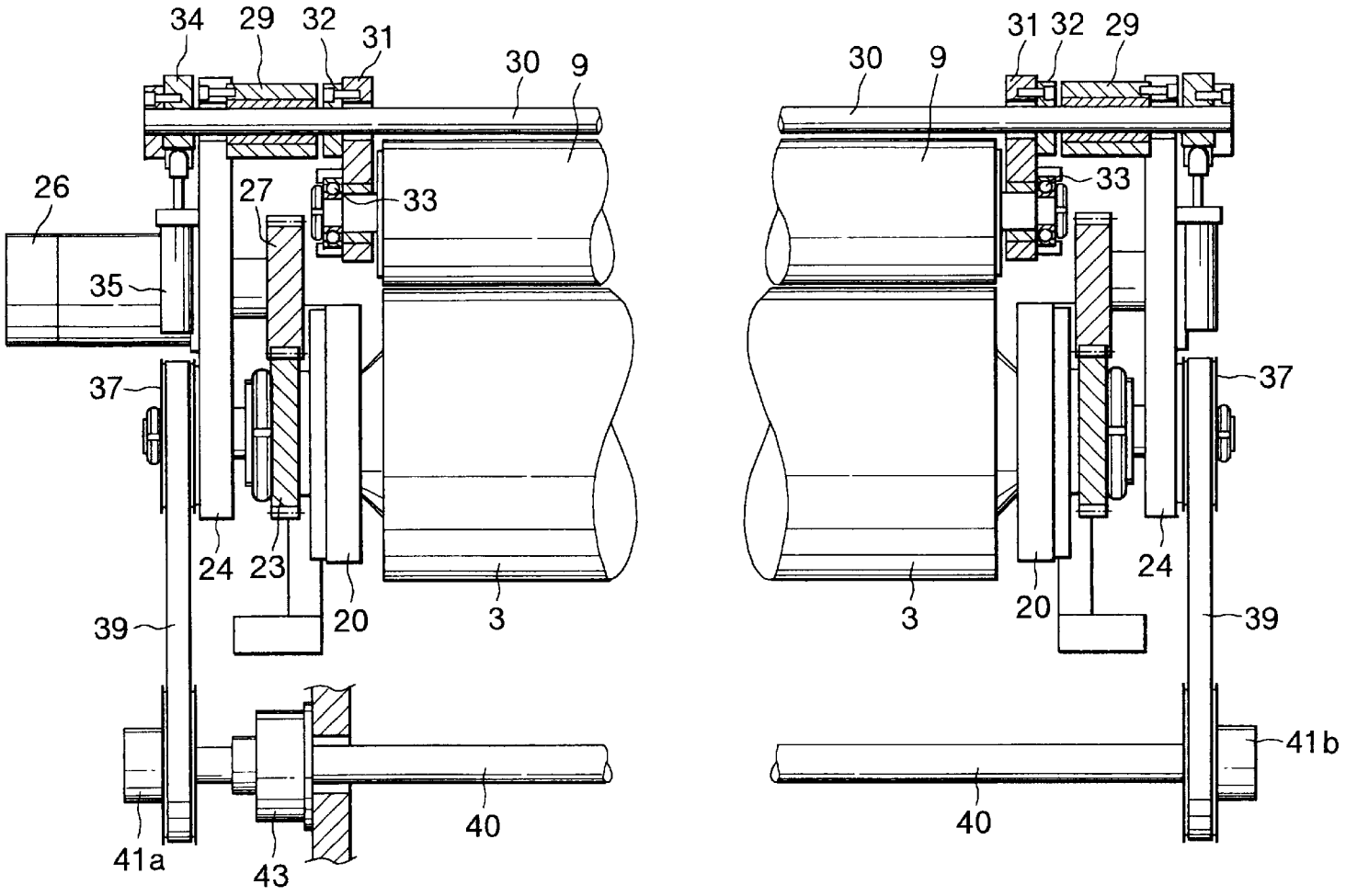
FIG. 3 is a plan view, in partial section, of the urging rotary member, a driven rotary member and surrounding elements, viewed at from an upstream side in an endless belt conveying direction.

As shown in FIGS. 2 and 3, the driven roller 3 for mounting the endless belt 1 is rotatably mounted within the apparatus. As shown in FIG. 4, the driven roller 3 is supported by bearings 22 held in bearing holders 21 attached to side plates 20. Driven roller spur wheels (gears) 23 are mounted on both ends of the driven roller 3 so that a rotational force of the driven roller 3 can be transmitted to the gears 23 through keys 23*a*.

Rock arms 24 (acting as rock members pivotally supported around the driven roller 3) are pivotally mounted on both ends of the driven roller via bearings 25. A rocking movement of the rock arm 24 is effected by a rock arm driving motor 26 secured to the rock arm 24. Driving motor spur wheel (gear) 27 is mounted on a drive shaft of the rock arm driving motor 26 so that power from the rock arm driving motor 26 is transmitted to the gear 27 through keys 28.

The driven roller spur gear 23 and the driving motor spur gear 27 are meshed with each other, with the result that, when the rock arm driving motor 26 is operated and the power is transmitted to the spur gear 27, the spur gear 27 is revolved around the driven roller spur gear 23. Due to this revolution, the rock arms 24 are rocked around the driven roller 3.

A transmission shaft 30 is rotatably supported by guide bushes 29 secured to the rock arms 24, and transmission clamp set collars 32 secured to urging roller attaching plates 31 are clamped on the transmission shaft 30. With this arrangement, a rotational force of the transmission shaft 30 is transmitted to the urging roller attaching plates 31 so that the plates 31 are rocked around a center of the transmission shaft 30.

As shown in FIG. 5, the urging roller 9 is rotatably supported by the urging roller attaching plates 31 via bearings 33. Further, at outer sides of the rock arms 24, transmission shaft clamp set collars 32 are secured to the transmission shaft 30, and the collars are also secured to urging roller driving arms 34.

The urging roller driving arms 34, transmission shaft 30, urging roller attaching plates 31, rock arms 24 and the like constitute a support means for supporting the urging rotary member, and the rock arms 24, rock arm driving motor 26, driving motor spur gears 27, driven roller spur gears 23 and the like constitute drive means for driving the support means. Further, a shifting means for shifting the urging rotary member relative to the endless belt at a constant relative speed is constituted by the support means, drive means, driven roller 3 and the like.

With this arrangement, the urging roller driving arms 34 are rocked or rotated together with the transmission shaft 30, and, thus, the rocking movement of the urging roller driving arms 34 is transmitted as the rotational movement of the transmission shaft 30. Further, there is provided urging cylinders (urging force applying means) 35 capable of abutting against one end of the urging roller driving arms 34 so that the urging force of the urging roller 9 is generated by the urging cylinders 35.

That is to say, when the urging cylinders 35 are extended in a direction shown by the arrow a in FIG. 2, the thrust forces of the cylinders are applied to the ends of the respective urging roller driving arms 34 to rotate the urging roller driving arms 34 together with the transmission shaft 30. The rotational force of the transmission shaft 30 is transmitted to the urging roller attaching plates 31 to rotate the urging roller attaching plates 31 together with the transmission shaft 30, thereby urging the urging roller 9 against the endless belt 1 supported by the driven roller 3. The urging force of the urging roller 9 urged against the endless belt 1 is adjusted by air pressure supplied to the urging cylinders 35.

Further, there are provided urging force releasing springs 36 each of which has one end attached to the corresponding urging roller driving arm 34 at a position between the portion connected to the transmission shaft 30 and the portion engaged by the urging cylinder 35 and the other end connected to the corresponding rock arm 24. Accordingly, when the urging cylinders are in a retracted condition, the urging roller driving arms 34 are always biased toward a direction shown by the arrow b in FIG. 2 by the spring forces of the urging force releasing springs 36, with the result that the urging roller 9 is spaced apart from the endless belt 1. To the contrary, when the urging cylinders 35 are extended, the thrust forces of the cylinders 35 overcome the spring forces of the urging force releasing springs 36, with the result that the urging roller 9 is urged against the endless belt 1 with the predetermined pressure as mentioned above.

As shown in FIG. 3, Transmission pulleys 37 are secured on outer surfaces of the pair of the rock arms 24 via bolts disposed in alignment with the center line of the driven roller 3. The transmission pulleys 37 are connected, through timing belts 39, to a brake pulley 41*a* and a pulley 41*b*, respectively, which are provided on both ends of a rockable transmission shaft 40. A rotational movement of the brake pulley 41*a* is transmitted to the rockable transmission shaft 40 through keys 42 shown in FIG. 3.

The rock arm driving motor 26 is attached to one of the rock arms 24, and the movement of this rock arm 24 is transmitted to the other rock arm 24 through the transmission pulley 37, timing belt 39, brake pulley 41*a*, transmission shaft 40, pulley 41*b*, timing belt 39 and transmission pulley 37, thereby rocking the rock arms in synchronism with each other. A brake which can be operated when the power is off to lock the rockable transmission shaft 40 to the apparatus (thereby stopping this transmission shaft) is provided on the rockable transmission shaft 40. Thus, as the rock arm driving motor 26 is turned OFF when the power source is turned OFF or if an abnormal condition occurs, the brake 43 is operated to lock the rockable transmission shaft 40, thereby preventing the rock arms 24 from lowering by their own weights.

FIGS. 6 and 7 show a rocking angle of the urging roller 9 (with respect to the endless belt 1 supported by the driven roller 3) held by the rock arms 24 rocked around the driven roller 3 by the engagement between the driving motor spur gear 27 and the driven roller spur gear 23.

The driven roller 3 is subjected to cyclic intermittent movement (one cycle corresponds to the continuous movement of the driven roller from a certain stopped condition to the next stopped condition), and a rotation angle of the driven roller 3 during each intermittent movement corresponds to a shift amount of the cloth web 4 fed by the endless belt 1. That is to say, when a shift amount of the cloth web 4 fed during one cycle is L, a diameter of the driven roller 3 is D and the rotation angle of the driven roller 3 is θ°, the following relation is established:

$$L=(\theta^\circ/360^\circ)\times\pi D$$

The rock arm 24 is controlled by the rock arm driving motor 26 in such a manner that the rock arm is rotated by an angle of θ° during one cycle of the driven roller.

When the driven roller 3 is rotated, the driven roller spur gear 23 is also rotated accordingly. Therefore, although the rotational force of the gear 23 is transmitted to the driving motor spur gear 27, since the rock arm driving motor 26 has large torque sufficient to rock all of the rockable elements including the rock arms 24, urging roller 9, guide roller 8 and the like, even when the driven roller spur gear 23 is rotated due to the rotation of the driven roller 3, the rock arm driving motor 26 is not rotated idly. Accordingly, when the driven roller spur gear 23 is rotated due to the rotation of the driven roller 3, the rotational force of the gear 23 acts to lift the rock arms 24 (in a direction shown by the arrow c in FIG. 6). Further, also at this point, the rock arm driving motor 26 continues to rotate at a constant speed.

In this way, even when the driven roller 3 is stopped or rotated intermittently, the relative revolving speed of the urging roller 9 (relative to the driven roller 3) given by the rock arm driving motor 26 is always kept constant, thereby urging the cloth web 4 against the endless belt 1 continuously. Accordingly, in the normal operation, the cloth web 4 can be closely contacted with the endless belt without any streaks.

FIGS. 8 and 9 show extension and retraction of the urging cylinder 35. FIG. 8 shows a condition that the urging cylinder 35 is extended to urge the urging roller 9 against the endless belt 1. In this condition, the cloth web 4 can be directed to the endless belt 1 and be closely contacted with the endless belt. FIG. 9 shows a condition that the urging cylinder 35 is retracted to release the urging force of the urging roller 9 from the endless belt 1. When the normal operating condition is changed to a waiting condition or a stopped condition due to abnormity, this condition shown in FIG. 9 is maintained and the rock arm driving motor 26 is also stopped.

In this case, if the urging cylinder 35 is extended as shown in FIG. 8 to urge the urging roller 9 against the endless belt 1, the streak will be formed on the cloth web 4. Thus, this is not preferable. To avoid this, by retracting the urging cylinder 35 as shown in FIG. 9 to release the urging force of the urging roller 9, even if the normal operating condition is changed to the waiting condition or the stopped condition due to abnormity, the streak can be prevented from being formed on the cloth web 4. In this case, if the urging roller 9 is separated from the cloth web 4, when the urging roller 9 urges the cloth web 4 again, the streak will be likely to be formed on the cloth web 4 due to the impact force of the urging roller.

To prevent the formation of the streak in this way, it is necessary to release the urging force of the urging roller without separating the urging roller 9 from the cloth web 4. To achieve this, the urging force releasing springs 36 comprise coil springs for releasing the urging force acting on the cloth web 4 due to the weights of the urging roller 9 and associated support elements themselves. By the action of the springs 36, it is possible to release the urging force without separating the urging roller 9 from the cloth web 4.

However, if the urging roller is always contacted with the endless belt 1, since the setting of the cloth web 4 becomes difficult, as shown in FIG. 10, by lowering the urging roller driving arm 34 by manipulating a lever 44 attached to the urging roller driving arm 34, the urging roller 9 can be separated from the endless belt 1.

The urging roller driving arm 34 to which the lever 44 is to be attached is provided at its end with a hole into which the lever 44 can be inserted. Accordingly, after the lever 44 is inserted into the hole and then the urging roller driving arm 34 is lowered, by inserting a stopper 45 into a hole formed in the rock arm 24 at a predetermined position, the urging roller driving arm 34 can be maintained in a lowered position.

FIG. 11 shows sensors for detecting the position of the rock arm 24. A home position sensor 46 serves to ascertain a home position (initial position) of the rock arm driving motor 26 and also acts as a sensor for ascertaining a start position of the rock arm 24. An overrun sensor 47 serves to regulate the position of the urging roller 9.

When the driven roller 3 is rotated to return the rock arms 24 in the rotational direction of the driven roller 3, if the urging roller 9 is returned to a position exceeding its start position for any reason such as positional deviation, timing deviation or the like, the urging roller 9 will be urged against a portion of the endless belt 1 which is not directly supported by the driven roller 3. If such a condition occurs, excessive tension will be applied to the endless belt 1, which may be damaged. To avoid this, the position of the urging roller 9 is regulated by the overrun sensor 47. Immediately after a detection signal is emitted from the overrun sensor 47, the supplying of power to the rock arm driving motor 26 is interrupted, with the result that the output shaft of the rock arm driving motor 26 becomes a torque free condition. At the same time, the brake 43 is activated to stop the rock arms 24. In this case, if an abnormal signal is emitted, the urging cylinders are retracted, thereby releasing the urging force of the urging roller 9.

If the rotation angle of the rock arm 24 is greater than the cloth web shifting amount of the driven roller 3, the rock arms 24 are gradually deviated downwardly. In this case, the position of the rock arm 24 is regulated by an overrun sensor 48. When a detection signal is emitted from the overrun sensor 48, the rock arm driving motor 26 is stopped. However, since the supplying of power to the rock arm driving motor 26 is not interrupted, the torque of the output shaft of the rock arm driving motor 26 is kept as it is. At the same time, the urging cylinders 35 are retracted to release the urging force of the urging roller 9.

When the intermittent rotation of the driven roller 3 is finished, the rock arms 24 are lifted upwardly (in a direction shown by the arrow c in FIG. 11) again. From this point, the urging cylinders 35 start to be extended to apply the urging force to the urging roller 9, and the rock arm driving motor 26 starts to be rotated again.

While the above-mentioned sensors were disposed on the side plate 20, such sensors may be provided at other positions. For example, a detection dog may be provided on the brake pulley and such sensors may be disposed on such a dog.

Since the sheet convey apparatus according to the present invention has the above-mentioned construction and function, it is possible to continuously drive the drive means for driving the support means supporting the urging rotary member, regardless of the intermittent movement or stoppage of the endless belt, with the result that any portion of the sheet can be closely contacted with the endless belt with the constant urging force. As a result, the sheet can be closely contacted with the endless belt without any streak.

Further, in the printer having the above-mentioned sheet convey apparatus, since the image is printed, by means of the recording means, on the sheet conveyed by the function of the sheet convey apparatus, high quality printing can be achieved. Incidentally, the sheet conveyed by the present invention may be a fabric web, paper sheet, resin film or the like, as well as the cloth web. Further, in place of the endless belt, a convey roller may be used as the convey means. Also in this case, the urging roller as the urging rotary member is supported in such a manner that the roller can be revolved around the convey roller.

What is claimed is:

1. A sheet conveying apparatus, comprising:

an endless belt for conveying a sheet, said endless belt being spanned around a plurality of rotating members and having a surface to which the sheet is removably adhered;

an adhering rotator member for adhering the sheet to said endless belt;

press means for pressing said adhering rotator member onto said endless belt;

support means for supporting said adhering rotator member rotatably, said support means being rockable to shift said adhering rotator member along a surface of one of said plurality of rotating members; and drive means for driving said support means, said drive means reciprocally rocking said support means when said adhering rotator member presses the sheet onto said endless belt.

2. A sheet supporting apparatus according to claim 1, wherein said support means includes a support member for supporting said adhering rotator member to be rotated about a rotating axis of one of said rotating members.

3. A sheet conveying apparatus according to claim 1, further comprising release means for releasing pressing of the sheet onto said endless belt.

4. A sheet conveying apparatus according to claim 1, wherein said drive means is positioned on said support means.

5. A sheet conveying apparatus according to claim 2, wherein said support means is connected with the one of said rotating members and rotated in response to rotation thereof.

6. A sheet conveying apparatus according to claim 1, wherein said drive means rocks said support means in response to shifting of said endless belt.

7. A sheet conveying apparatus according to claim 1, wherein said support means is supported to be rocked in a normal direction and a reverse direction about a rotating axis of the one of said rotating members.

8. A sheet conveying apparatus, comprising:

an endless belt for conveying a sheet, said endless belt being spanned around a plurality of rotating members and having a surface to which the sheet is removably adhered;

an adhering rotator member for adhering the sheet to said endless belt;

shift means for shifting said adhering rotator member between a pressing position to press the sheet onto said endless belt and a releasing position to release the pressing in a state where said shift means is contacted with the sheet; and drive means for shifting said adhering rotator member positioned at the pressing position along a surface of one of said plurality of rotating members.

9. A printer comprising:

an endless belt for conveying a sheet, said endless belt being spanned around a plurality of rotating members and having a surface to which the sheet is removably adhered;

an adhering rotator member for adhering the sheet to said endless belt;

press means for pressing said adhering rotator member onto said endless belt;

support means for supporting said adhering rotator member rotatably, said support means being rockable to shift said adhering rotator member along a surface of one of said plurality of rotating members; and drive means for driving said support means, said drive means reciprocally rocking said support means when said adhering rotator member presses the sheet onto said endless belt; and record means for performing recording on the sheet adhered to said endless belt.

10. A printer according to claim 9, wherein the sheet is a cloth.

11. A printer comprising:

an endless belt for conveying a sheet, said endless belt being spanned around a plurality of rotating members and having a surface to which the sheet is removably adhered;

an adhering rotator member for adhering the sheet to said endless belt;

shift means for shifting said adhering rotator member between a pressing position to press the sheet onto said endless belt and a releasing position to release the pressing in a state where said shift means is contacted with the sheet;

drive means for shifting said adhering rotator member positioned at the pressing position along a surface of one of said plurality of rotating members; and record means for performing recording on the sheet adhering to said endless belt.

12. A printer according to one of claims 9 to 11, wherein said record means comprises ink-jet recording means.

13. A printer according to claim 12, wherein said ink-jet recording means performs the recording with ink droplets generated by heating.

14. A web printing apparatus, comprising:

web convey means for conveying a web, said web convey means including a rotating member having a surface to which the web is removably adhered and conveying the adhered web;

an adhering rotator member for adhering the web to said rotating member;

drive means for reciprocally shifting said adhering rotator member along a surface of said rotating member in a state where said adhering rotator member is pressed onto the web; and record means for performing recording on the web adhered to said rotating member.

15. A web printing apparatus according to claim 14, wherein said drive means shifts said adhering rotator member along the surface of said rotating member in response to conveying of the web.

16. A web printer according to claim 14, further comprising a shift means for shifting said adhering rotator member between a pressing position to be pressed onto said rotating member and a releasing position to release the pressing thereof.

17. A web printer according to claim 14, further comprising shift means for shifting said adhering rotator member among a pressing position to be pressed onto said rotating member, a contact position to release the pressing onto said rotating member, and a retracted position retracted from said rotating member.

18. A web printing apparatus according to claim 14, wherein the web is a cloth.

19. A web printing apparatus according to claim 14, wherein said rotating member has an adhesive surface.

20. A web printing apparatus according to claim 14, wherein said recording means comprises an ink-jet recording means.

21. A web printing apparatus according to claim 20, wherein said ink-jet recording means performs the recording with ink droplets generated by heating.

22. A web printing apparatus comprising:

web convey means for conveying a web, said web convey means including a plurality of rollers, and an endless belt having a surface to which the web is removably adhered and conveying the adhered web;

an adhering rotator member for adhering the web to said endless belt;

shift means for shifting said adhering rotator member along a surface of one of said plurality of rollers, in response to rotation of the one of said plurality of rollers; and press release means for shifting said adhering rotator member between a pressing position to be pressed onto said endless belt and a release position to release the pressing of said adhering rotator member onto said endless belt.

23. A web printing apparatus according to claim 22, wherein said shift means includes a support member supporting said adhering rotator member and rocking about a rotating shaft of the one of said plurality of rollers, and drive means for rocking said support member.

24. A web printing apparats according to claim 23, wherein said drive means includes connect means for operably connecting said support member and the one of said plurality of rollers.

25. A web printing apparatus according to claim 23, wherein a first gear disposed on said support member and a second gear connected to the one of said plurality of rollers are meshed with each other, so that the first gear revolves on a circumferential surface of the second gear in response to the rotation of said second gear.

26. A web printing apparatus according to claim 25, wherein the first gear is connected to said drive means.

27. A web printing apparatus according to claim 26, wherein said drive means comprises a motor.

28. A web printing apparatus according to claim 23, further comprising detecting means for detecting a rocked position of said support member.

29. A web printing apparatus according to claim 28, wherein driving of drive means is controlled by an outputted signal of said detection means.

30. A web printing apparatus according to claim 22, wherein the web is a cloth.

31. A web printing apparatus according to claim 30, wherein said record means performs recording with ink droplets.

* * * * *

UNITED STATES PATENT AND TRADEMARK OFFICE

CERTIFICATE OF CORRECTION

PATENT NO. : 5,883,654

DATED : March 16, 1999

INVENTOR(S) : KATSUYAMA

It is certified that error appears in the above-identified patent and that said Letters Patent is hereby corrected as shown below:

COLUMN 3,

Line 17, "at" should be deleted.

Line 26, "VI-VI" should read --VII-VII--.

COLUMN 4,

Line 46, "VI-VI" should read --VII-VII--.

Signed and Sealed this

Fourteenth Day of December, 1999

*Attest:*

*Attesting Officer*

Q. TODD DICKINSON

*Acting Commissioner of Patents and Trademarks*